US012410710B2

(12) United States Patent
Doyle

(10) Patent No.: US 12,410,710 B2
(45) Date of Patent: Sep. 9, 2025

(54) PNEUMATIC MOTOR

(71) Applicant: CIRCLE DYNAMICS, INC., Peterborough (CA)

(72) Inventor: James Laurence Doyle, Cavan (CA)

(73) Assignee: Circle Dynamics, Inc., Peterborough (CA)

( * ) Notice: Subject to any disclaimer, the term of this patent is extended or adjusted under 35 U.S.C. 154(b) by 736 days.

(21) Appl. No.: 17/603,366

(22) PCT Filed: Mar. 30, 2020

(86) PCT No.: PCT/CA2020/050412

§ 371 (c)(1),
(2) Date: Oct. 13, 2021

(87) PCT Pub. No.: WO2020/210895

PCT Pub. Date: Oct. 22, 2020

(65) Prior Publication Data

US 2022/0195872 A1 Jun. 23, 2022

Related U.S. Application Data

(60) Provisional application No. 62/835,056, filed on Apr. 17, 2019.

(51) Int. Cl.
*F01B 1/06* (2006.01)
*F01B 25/02* (2006.01)

(52) U.S. Cl.
CPC ..... *F01B 1/062* (2013.01); *F01B 1/0644* (2013.01); *F01B 1/0655* (2013.01); *F01B 25/02* (2013.01)

(58) Field of Classification Search
CPC ..... F01B 1/062; F01B 1/0644; F01B 1/0655; F01B 25/02; F04B 27/0451; F04B 27/0456; F04B 27/1009; F04B 27/1018
(Continued)

(56) References Cited

U.S. PATENT DOCUMENTS 871,660 A 11/1907 Andrews
2,372,523 A * 3/1945 Sinclair ..... F04B 1/0456 92/72

(Continued)

FOREIGN PATENT DOCUMENTS

| | | |
|---|---|---|
| CN | 201162546 | 12/2008 |
| CN | 202467931 | 10/2012 |
| CN | 202691018 | 1/2013 |

OTHER PUBLICATIONS

International Search Report mailed on Jun. 17, 2020 for PCT/CA2020/050412.

*Primary Examiner* — Philip E Stimpert
(74) *Attorney, Agent, or Firm* — Potomac Law Group, PLLC; Joseph F. Murphy

(57) ABSTRACT

A pneumatic motor for rotating an axle including: a. a housing including: b. an air intake port; c. an air exhaust port; d. at least two cylinders; each cylinder being positioned radially from the axle; e. at least two air channels in communication with each cylinder; f. at least two pistons, each piston attached to the axle by a connecting rod, each piston and respective connecting rod being radially aligned, each piston to be received in one of said at least two cylinders; each connecting rod being attached centrally offset in relation to a central axis of the axle; wherein when one connecting rod and piston are in power stroke, the other connecting rod and piston are in exhaust stroke.

7 Claims, 12 Drawing Sheets

(58) Field of Classification Search
USPC ..... 91/491, 498, 503
See application file for complete search history.

(56) References Cited

U.S. PATENT DOCUMENTS

| | | | | | |
|---|---|---|---|---|---|
| 3,080,363 | A * | 3/1963 | Horwitz | C07D 277/64 | 546/175 |
| 3,090,363 | A | 5/1963 | Stuver | | |
| 3,730,054 | A * | 5/1973 | Dickinson | F03C 1/0438 | 91/491 |
| 4,704,946 | A * | 11/1987 | Okada | F01B 29/00 | 91/470 |
| 5,049,039 | A | 9/1991 | Knoth et al. | | |
| 2015/0322997 | A1* | 11/2015 | Hritz | F04B 39/0094 | 417/374 |
| 2016/0160645 | A1 | 6/2016 | Doyle | | |

* cited by examiner

PNEUMATIC MOTOR

FIELD OF THE DISCLOSURE

This disclosure relates to a pneumatic motor with improvements thereto including multiple stacked radial pistons, unitary cylinder cap, a modular valve bushing and a controller for regulating air speed, air supply, motor speed and reading of speed and air supply and torque, depending on load.

BACKGROUND

Current pneumatic motors (or air motors) include pistons aligned in the same plane. It has been found that pneumatic motors with pistons in the same plane result in the requirement of thrust washers and retainers to allow rotation without interference. Furthermore, current pneumatic motors include valve bushings that are unitary. It has been found that unitary valve bushings result in galling and seizing of the pneumatic motor due to the entry of unwanted particles via the air source into the motor. Furthermore, current pneumatic motors include cylinder covers that are multi-component. It has been found that multi-component cylinder covers result in the build-up of unwanted heat in the motors as well as air loss, reducing the efficiency of the pneumatic motor. Furthermore, current pneumatic motors lack a controller to regulate air speed, motor speed, air supply to the motor as well as reading and transmission of data associated with the pneumatic motor. There is a need for a pneumatic motor with pistons being in different parallel planes. There is also a need for a pneumatic motor with modular valve bushings. There is also a need for a pneumatic motor with a unitary cylinder cap. There is also a need for a pneumatic motor controller.

SUMMARY

According to one aspect, there is provided:

a pneumatic motor for rotating an axle comprising:

a housing comprising an air intake port;

an air exhaust port;

at least two cylinders; wherein each cylinder is positioned radially from the axle; in one alternative, each cylinder being in a distinct radial plane from each other;

at least two air channels in communication with each cylinder;

at least two pistons, each piston attached to the axle by a connecting rod, each piston and respective connecting rod being radially aligned, in respect of the axle and in one alternative, in a distinct radial plane from each other, each piston to be received in one of said at least two cylinders; each connecting rod being attached centrally offset in relation to a central axis of said axle;

According to another aspect, there is provided a modular bushing fit onto said axle to regulate communication of said air intake port and said air exhaust port with said at least two air channels in communication with each cylinder;

wherein during a power stroke of one piston or more, said axle allows said air intake port to be in communication with the air channel in communication with said one cylinder allowing air from the air intake port to enter into the cylinder; and during an exhaust stroke of one piston or more, said axle allows said air exhaust post to be in communication with the air channel in communication with said one cylinder allowing air to exit the cylinder through the air exhaust port;

wherein, when one connecting rod and piston are in power stroke, the other connecting rod and piston are in exhaust stroke.

In another alternative, one end of each of said connecting rods are stacked one atop another on said axle, in an axially offset configuration, resulting in each of said connecting rods and each of said pistons connected to said respective connecting rod being in a distinct radial plane, each distinct radial plane being parallel to each other.

In another alternative, each of said connecting rods is stacked one atop another and is separated one from another by a spacer on said axle.

In another alternative, each of said connecting rods stacked one atop another further comprise a bearing on said axle between each of said connecting rods.

In another alternative, said axle further comprises an air intake face and an air exhaust face.

In another alternative, said air intake face and said air exhaust face run along a length of said axle and are opposite each other along the length of said axle.

In another alternative, said pneumatic motor further comprises a modular valve bushing to fit over said axle for allowing communication of air to/from the pneumatic motor, depending on the rotational location of said axle in relation to said modular valve bushing. The modular valve bushing described herein differs from the prior art bushing made of a single piece which has exhibited the following drawbacks including the inability to use a bearing material in the sealing area to eliminate the possibility of galling as well as the opportunity to provide minimal interference to reduce air consumption and leakage. In one alternative, said modular valve bushing comprises an upper component, a lower component and an intermediary component wherein the upper component and lower component are matingly engaged with each other by said intermediary component.

In another alternative, said upper component, lower component and intermediary component are hollow cylinders, each having an outer diameter surface and at least one inner diameter surface.

In another alternative, the outer diameter surface of said intermediary component matingly engages with the inner diameter of said upper component and lower component.

In another alternative said upper component is a hollow cylinder having a top surface, a bottom surface, an outer collar surface and an inner collar surface. In yet another alternative, said upper component further comprises a plurality of air inlet and outlet channels. In one alternative, said air inlet and outlet channels run axially and radially to said hollow cylinder of said upper component. In one alternative, a portion of said channels run axially to said hollow cylinder of said upper component and are air exhaust channels.

In another alternative, said lower component is a hollow cylinder having a top surface, a bottom surface, an outer collar surface and an inner collar surface. In yet another alternative, said lower component further comprises at least one air intake channel running axially to said hollow cylinder of said lower component. In one alternative, said at least one air intake channel running axially to said hollow cylinder of said lower component is situated at an upper portion of said lower component.

In another alternative, said intermediary component is a connecting collar for connecting said upper component with said lower component. In one alternative, said connecting collar further comprises an inner diameter surface and an outer diameter surface.

In another alternative, each of said upper component and lower component further comprise a connecting collar receiving section to each receive an end of said connecting collar top axially connecting the upper component with the lower component forming a cylinder valve bushing for a pneumatic motor. The lower component includes and upper area of a first diameter and a lower are of a second diameter. The second diameter being smaller than the first diameter allowing the connecting collar to be friction fitted within the upper and lower components, preferably causing said connecting collar to be non-rotating when connecting the upper and lower components.

In another alternative, said connecting collar is locked to said modular bushing via a locking pin. In one alternative, said connecting collar is locked to said upper component via a locking pin.

In another alternative, said air inlet channels of said upper component are in fluid communication with said at least one air intake channel of said lower component when said air intake face of said axle is in line with said at least one air intake channel of said lower component, during rotation of said axle.

In another alternative, said air outlet channels of said upper component are in fluid communication with said air exhaust port when said air exhaust face of said axle is in line with said air outlet channels of said upper component, during rotation of said axle. It has been found that the modular bushing, due to the surface characteristics of the connecting collar being softer or less dense than the surface characteristics of the rotating axle prevents foreign or unwanted particulates, that may enter with the air supply to the pneumatic motor, to impact and compromise the surface of the axle by allowing any foreign particulates to be absorbed by the surface of the connecting collar thereby mitigating damage (including seizing of the motor due to a foreign particulate between the connecting collar (intermediary bushing) surface and axle surface) to pneumatic motor parts by foreign particulate material entering the system with the air supply.

According to yet another alternative, there is provided a unitary piston cylinder cap in a pneumatic motor, in one alternative at least two unitary piston cylinder caps in a pneumatic motor, each cylinder cap forming a cylinder, on said pneumatic motor, each cylinder for receiving each of said at least two pistons, eliminating the need for a cylinder sleeve and associated seals thereby reducing the number of parts and mitigating air leakage between a cylinder cap and a cylinder sleeve, the prior art combination cylinder cap and a cylinder sleeve forming a piston cylinder.

In one alternative, said unitary piston cylinder cap further comprises an cylinder cap air channel for communication with said air channel in communication with said cylinder of said pneumatic motor housing for the exchange of air into and out of a space formed by a piston and a cylinder cap, in one alternative, each of said at least two unitary piston cylinder caps further comprise an cylinder cap air channel for communication with said air channel in communication with said cylinder of said pneumatic motor housing for the exchange of air into and out of a space formed by each of said at least two pistons and each of said at least two cylinder caps.

According to yet another alternative, there is provided a pneumatic motor for rotating an axle comprising:

a housing comprising an air intake port;

an air exhaust port;

at least three cylinders; wherein each cylinder is positioned radially from the axle; in one alternative, each cylinder being in a distinct radial plane from each other;

at least two air channels in communication with each cylinder;

at least three pistons, each piston attached to the axle by a connecting rod, each piston and respective connecting rod being radially aligned, and in one alternative, in a distinct radial plane from each other and each connecting rod being stacked in relation to each other, each piston to be received in one of said at least three cylinders; each connecting rod being attached centrally offset in relation to a central axis of said axle;

a modular bushing fit onto said axle to regulate communication of said air intake port and said air exhaust port with said at least two air channels in communication with each cylinder;

wherein during a power stroke of at least one piston, said axle allows said air intake port to be in communication with the air channel in communication with said one cylinder allowing air from the air intake port to enter into the cylinder; and during an exhaust stroke of at least one piston, said axle allows said air exhaust post to be in communication with the air channel in communication with said one cylinder allowing air to exit the cylinder through the air exhaust port;

wherein when one connecting rod and piston are in power stroke, the other connecting rod and piston are in exhaust stroke and the third connecting rod and piston are in between an exhaust stroke and a power stroke.

In one alternative, there is provided at least three unitary piston cylinder caps, each cylinder cap forming a cylinder, on said pneumatic motor, each cylinder for receiving each of said at least three pistons.

In one alternative, each of said at least three unitary piston cylinder caps further comprise an cylinder cap air channel for communication with said air channel in communication with said cylinder of said pneumatic motor housing for the exchange of air into and out of a space formed by each of said at least three pistons and each of said at least three cylinder caps.

In one alternative, each of said at least three unitary piston cylinder caps are in a distinct horizontal plane from each other.

According to yet another alternative, there is provided a pneumatic motor for rotating an axle comprising:

a housing comprising an air intake port;

an air exhaust port;

at least six cylinders; each cylinder being positioned radially from the axle; in one alternative each cylinder being in a distinct radial plane from each other;

at least two air channels in communication with each cylinder;

at least six pistons, each piston attached to the axle by a connecting rod, each piston and respective connecting rod being radially aligned, in respect of the axle and in one alternative, in a distinct radial plane from each other, each piston to be received in one of said at least six cylinders; each connecting rod being attached centrally offset in relation to a central axis of said axle;

a modular bushing fit onto said axle to regulate communication of said air intake port and said air exhaust port with said at least two air channels in communication with each cylinder;

wherein during a power stroke of at least one piston, said axle allows said air intake port to be in communication with the air channel in communication with a cylinder of the piston during a power stroke allowing air from the air intake port to enter into the cylinder; and during an exhaust stroke of at least one piston, said axle allows said air exhaust post to be in communication with the air channel in communication with a cylinder of the piston undergoing an exhaust stroke allowing air to exit the cylinder through the air exhaust port.

In one alternative, there is provided at least six unitary piston cylinder caps, each cylinder cap forming a cylinder, on said pneumatic motor, each cylinder for receiving each of said at least six pistons.

In one alternative, each of said at least six unitary piston cylinder caps further comprise an cylinder cap air channel for communication with said air channel in communication with said cylinder of said pneumatic motor housing for the exchange of air into and out of a space formed by each of said at least six pistons and each of said at least six cylinder caps.

In one alternative, there is provided a tachometer on said pneumatic motor to read rotations per minute of said axle.

In yet another alternative, there is provided a controller, in communication with said tachometer, to regulate air pressure, air flow, air speed and motor speed and torque, depending on the load on said motor.

It was found the intermediary component, in one alternative a collar, is resistant to heat expansion and contraction, and the coefficient of friction of the intermediary component, in one alternative a collar, surface is extremely low and further mitigates galling due to the surface of said intermediary component (in one alternative a collar) being of a material such that the surface absorbs any foreign particles thereby mitigating galling and seizing of said motor. A preferred material being Torlon™, polyvinylidene fluoride, glass filled Teflon™ and combinations thereof. Alternate materials are Teflon™, low density polyethylene, high density polyethylene, ultra high molecular weight (UHMW) Polyethylene, polypropylene, CE grade (canvas phenolic resin—general purpose grade) phenolic laminates, LE grade (cotton phenolic resin—electrical grade) phenolic laminates, nylon and combinations thereof.

It was also determined that the modular bushing results in reduced air consumption (30% to 40%) by the pneumatic motor as compared to a unitary bushing, improving efficiency without compromising performance of the pneumatic motor. We also found the collar (intermediary component) allows for a reduced gap between the inside diameter of the collar against the outside diameter of the rotating shaft resulting in less leakage of air between the space formed by the outside diameter of the rotating shaft and the inside diameter of the collar.

It was also found that the collar mitigates seizing of the shaft against the valve bushing.

DETAILED DESCRIPTION OF THE FIGURES

Figure 1B:
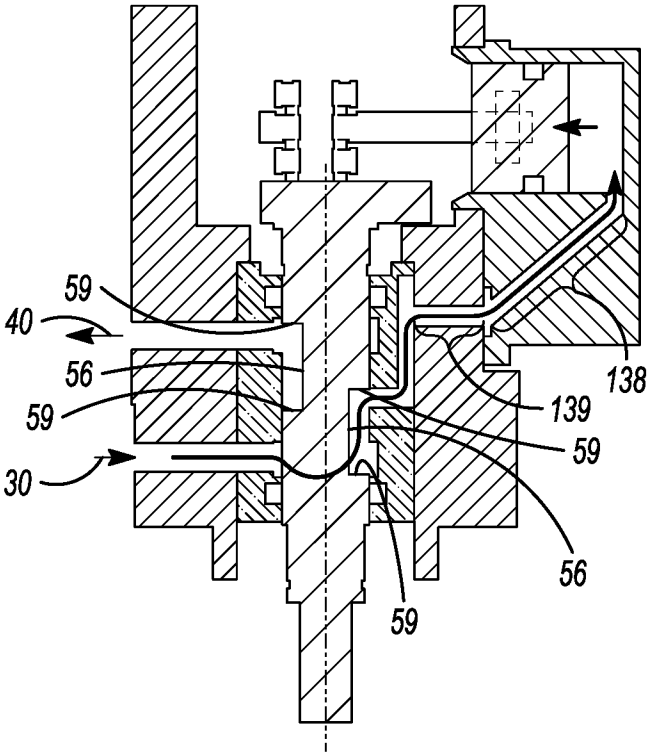
FIG. 1B is a cross sectional view of a pneumatic motor with the cylinder of FIG. 1A undergoing a power stroke, according to one alternative.
Figure 1A:
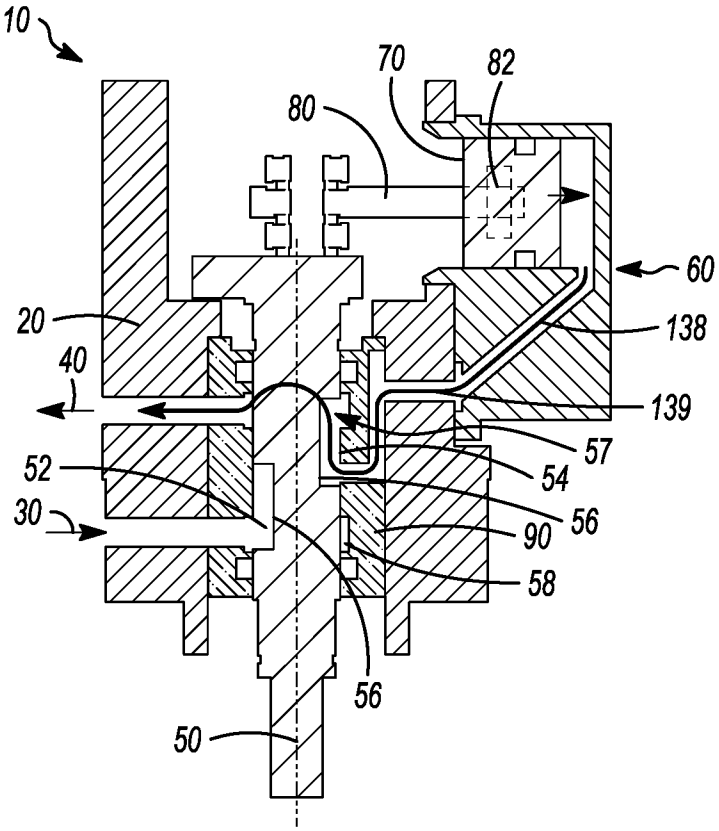
FIG. 1A is a cross sectional view of a pneumatic motor with one cylinder undergoing an exhaust stroke, according to one alternative.

Referring now to FIGS. 1A and 1B, there is depicted a cross-sectional view of the pneumatic motor 10, according to one alternative, undergoing an exhaust stroke (FIG. 1A) and a power stroke (FIG. 1B). In this alternative, the pneumatic motor 10 has a motor housing 20 with an air intake port 30 and air exhaust port 40 each running normal to axle (or crankshaft) 50. Axle 50 is rod shaped with step down reduction of diameter from a top end to a bottom end. Axle 50 has an air intake face 52 and an air exhaust face 54 along the length of the axle 50. Air intake face 52 opposes air exhaust face 54. Air intake face 52 and air exhaust face 54 each comprise a flat surface 56 indented into the axle 50 and running along a length of the axle 50 and each flat surface 56 terminating with end walls 59 running normal to the flat surface 56 and radially away from the longitudinal axis of the axle 50. Each of said air intake face 52 and air exhaust face 54 forming a horizontal slot on said axle 50. Said air intake face 52 is offset from said air exhaust face 54, preferably longitudinally offset from said air exhaust face 54. Cylinder cap 60 forms a cylinder for piston 70. Each piston 70 is connected to axle 50 via piston connecting rod 80. Piston connecting rod 80 is connected to said piston 70 via a wrist pin 82 allowing for a pendulum movement of said piston connecting rod 80 in relation to said piston 70 and a reciprocating movement of said piston 70 in relation to said cylinder formed by said cylinder cap 60. As best seen in FIG. 1A, during the exhaust stroke of one piston 70 of the pneumatic motor 10, piston 70 moves radially away from axle 50 and air exhaust face 54 is in line with air exhaust channel 57 (in the form of an annular ring) of lower bushing 90 resulting in air leaving through air exhaust port 40. During the exhaust stroke, air intake port 30 is blocked to the cylinder since air intake face 52 is not in communication with air intake channel 58 (in the form of an annular ring) of upper bushing 100.

Figure 2:
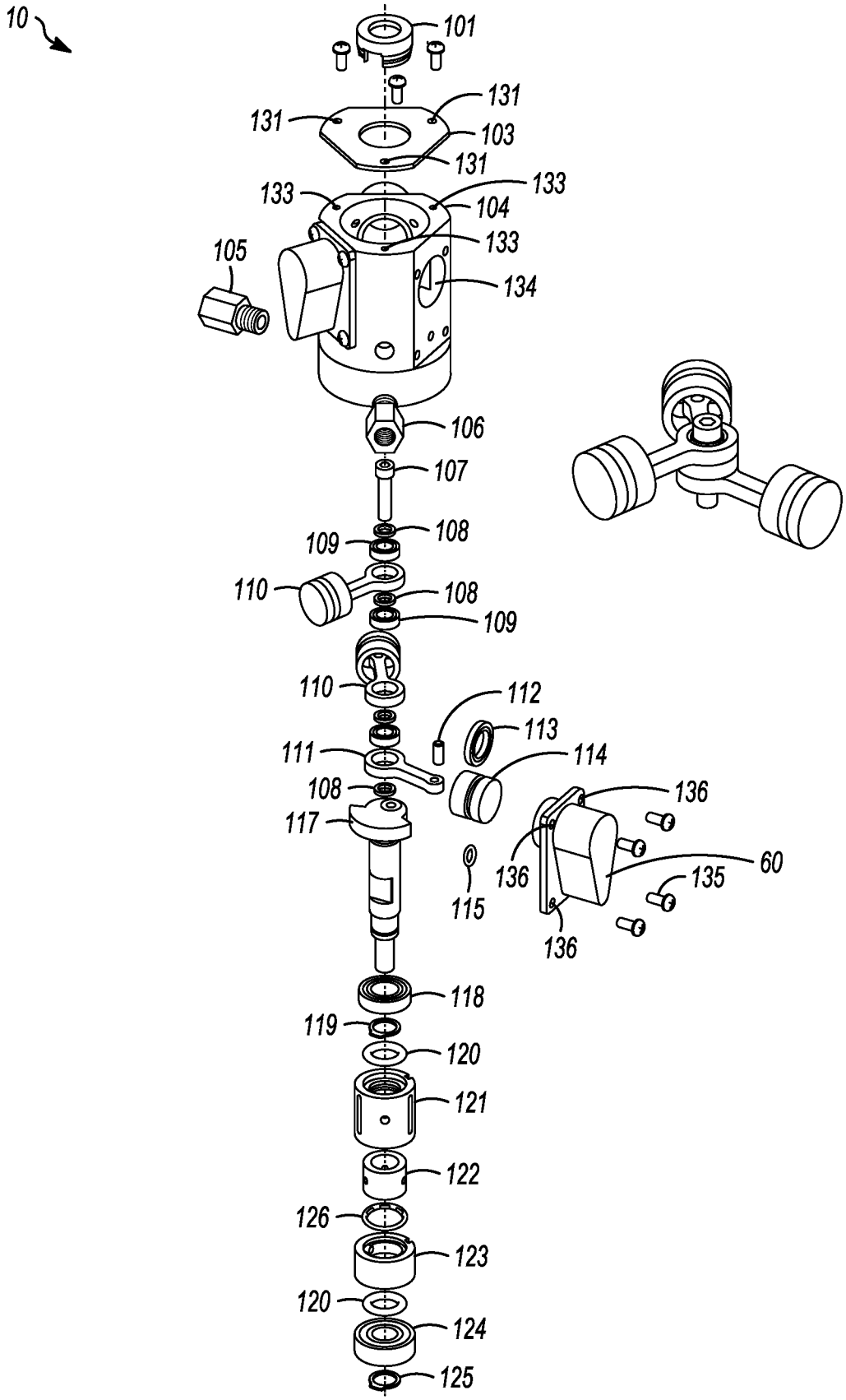
FIG. 2 is an exploded view of the pneumatic motor, as a three cylinder pneumatic motor, according to one alternative.

Referring now to FIG. 2, there is depicted an exploded view of the parts for an pneumatic motor 10 of FIGS. 1A and 1B having 3 cylinders, according to one alternative.

Figure 6B:
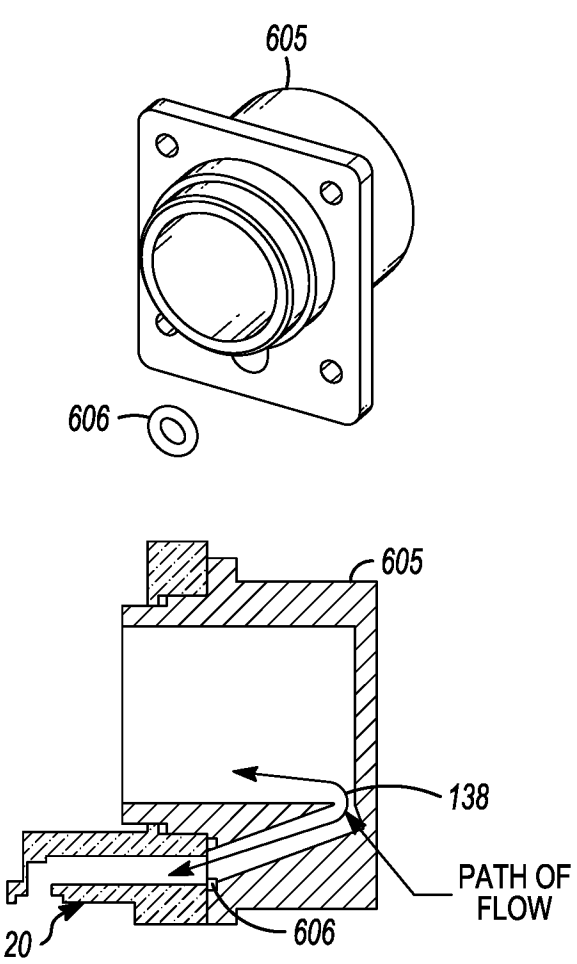
FIG. 6B is a cross-sectional view of a unitary cylinder cap, according to one alternative
Figure 7:
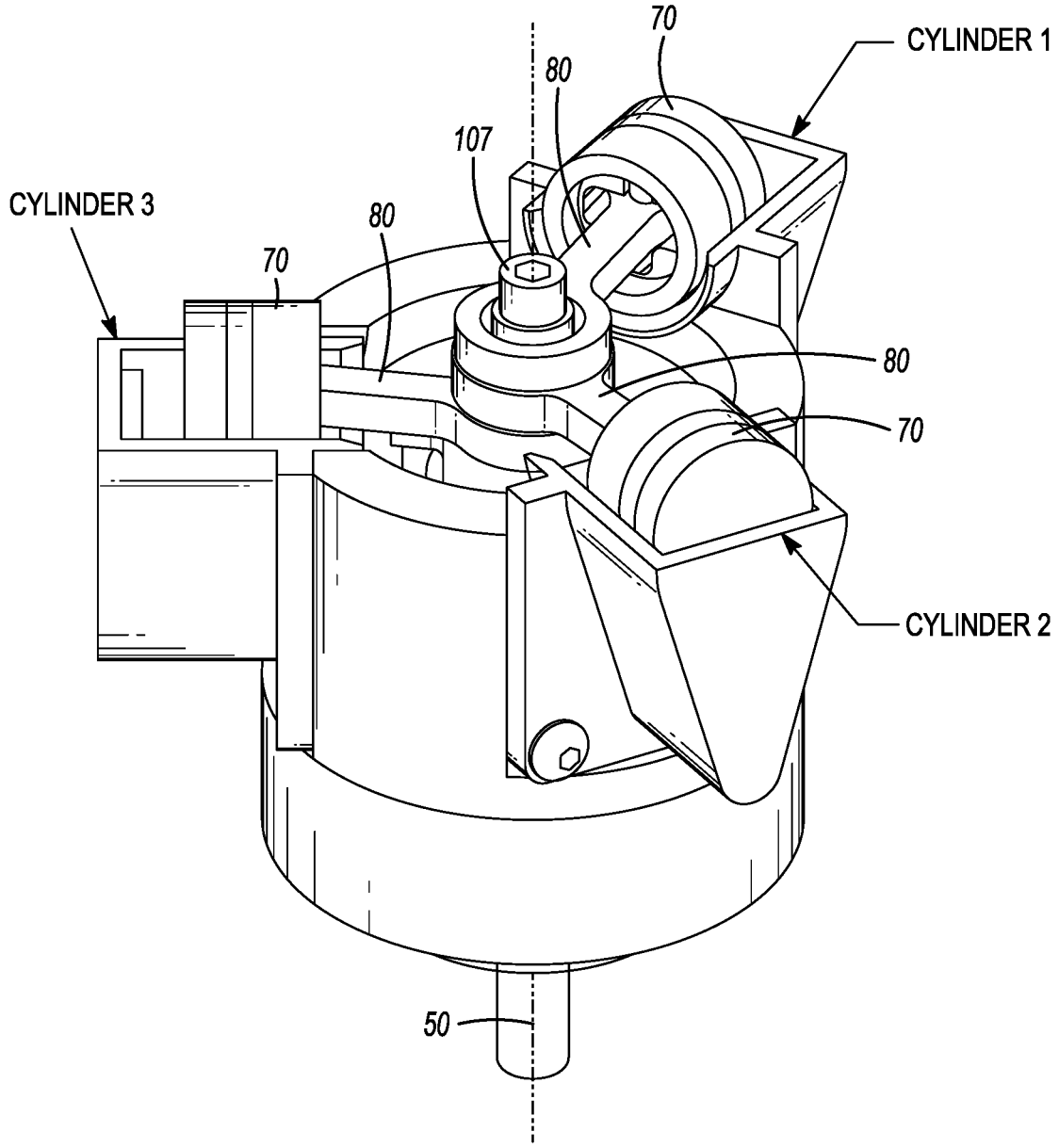
FIG. 7 is a cut-away view of the pneumatic motor according to one alternative

Pneumatic motor 10 includes a vent 101 (which may also serve as a window to the interior of said motor and may be made of a transparent material) centrally located (although it may be offset from center of the motor head cover 103) on an pneumatic motor head cover 103, in this alternative, the pneumatic motor head cover 103 is triangular in shape and has three fastener holes 131 for three fasteners 102 to allow for fastening the pneumatic motor head cover 103 onto the top of motor housing 104. Motor housing 104 includes three fastener holes 133 for alignment of pneumatic motor head cover 103 fastener holes 131. Motor housing 104 is cylindrical in shape with three cylinder ports 134 (only one seen) each for receiving each of the three pistons 114. Each cylinder port 134 is covered by a cylinder cap 60 (See FIG. 6B). Cylinder cap 60 is secured to the motor housing 104 by four cylinder cap fasteners 135, in this alternative four screws, each of which fit in the cylinder cap fastener receivers 136 on each cylinder cap 60 and on the motor housing 104. Cylinder cap 60 is sealed onto the motor housing 104 by a resilient seal 115, in this alternative an O-ring, used to form a seal at the end of the cylinder cap air channel 138 in the cylinder cap (see FIGS. 1A and 1B) between each of the cylinder caps 60 and each of motor housing cylinder air channel 139. As best seen in FIG. 2 and FIG. 7, in one alternative, each piston 114 and respective connecting rod 111 are stacked one atop the other offset the centre line of the axle 50 and secured onto the axle or crankshaft 117 with a crank pin 107. Between the crank pin 107 and axle end of the connecting rod 111 is a bearing 108 and a spacer 109 to facilitate rotational movement of the crank pin 107 in relation to the axle end of the connecting rod 111. Similarly, between each of the connecting rods is a bearing 108 and spacer 109 to facilitate rotational movement of the crank pin in relation to the axle end of the connecting rod 111 and to facilitate independent movement of each connecting rod in relation to each other. Around the circumferential wall of each piston 114 is a resilient seal 113 providing an air seal between the piston 114 and inside wall of the cylinder cap 60. Piston 114 is connected to the end distant the axle 117 of connecting rod 111 by a wrist pin 112 as discussed above. Modular bushing comprised of upper bushing 121, lower bushing 123, connected to each other via intermediary bushing connector 122 and bushing O-ring 126. Above the modular bushing is a bearing 118, snap ring 119 and O-ring 120 serving as a seal between the modular bushing (upper bushing 121, lower bushing 123) and axle 117. Below the modular bushing is a 124, snap ring 125 and O-ring 120 serving as a seal between the modular bushing and axle 117. Piston 114, connecting rod 111 and wrist pin 112 make up a piston assembly 110.

Motor housing further includes an air supply connector 105 threaded to the air supply port 30 (See FIG. 1A) and an air exhaust connector 106 threaded to the air exhaust port 40 (See FIG. 1A).

Figure 3A:
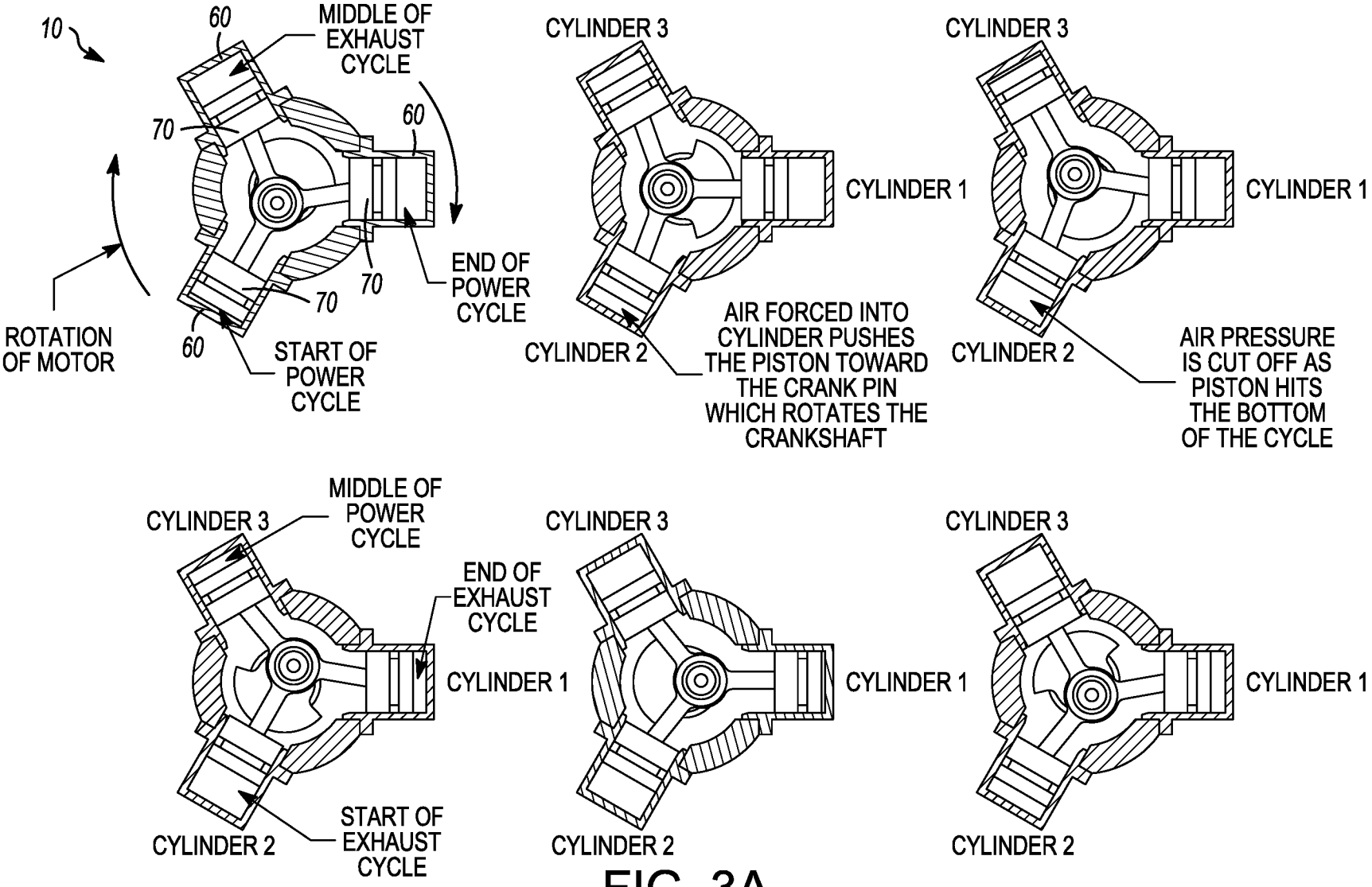
FIG. 3A is an overhead cross-sectional view of the pneumatic motor showing pistons at various stages of power stroke and exhaust stroke, according to one alternative.

Referring now to FIG. 3A, there is provided an overhead cross-sectional view of the pneumatic motor 10 and each piston 70 and different stages of power stroke and exhaust stroke of a 3-cylinder stacked piston pneumatic motor. Clearly depicted here is a stacked piston arrangement described above and the unitary cylinder cap 60 forming a cylinder for the piston 70.

Figure 3B:
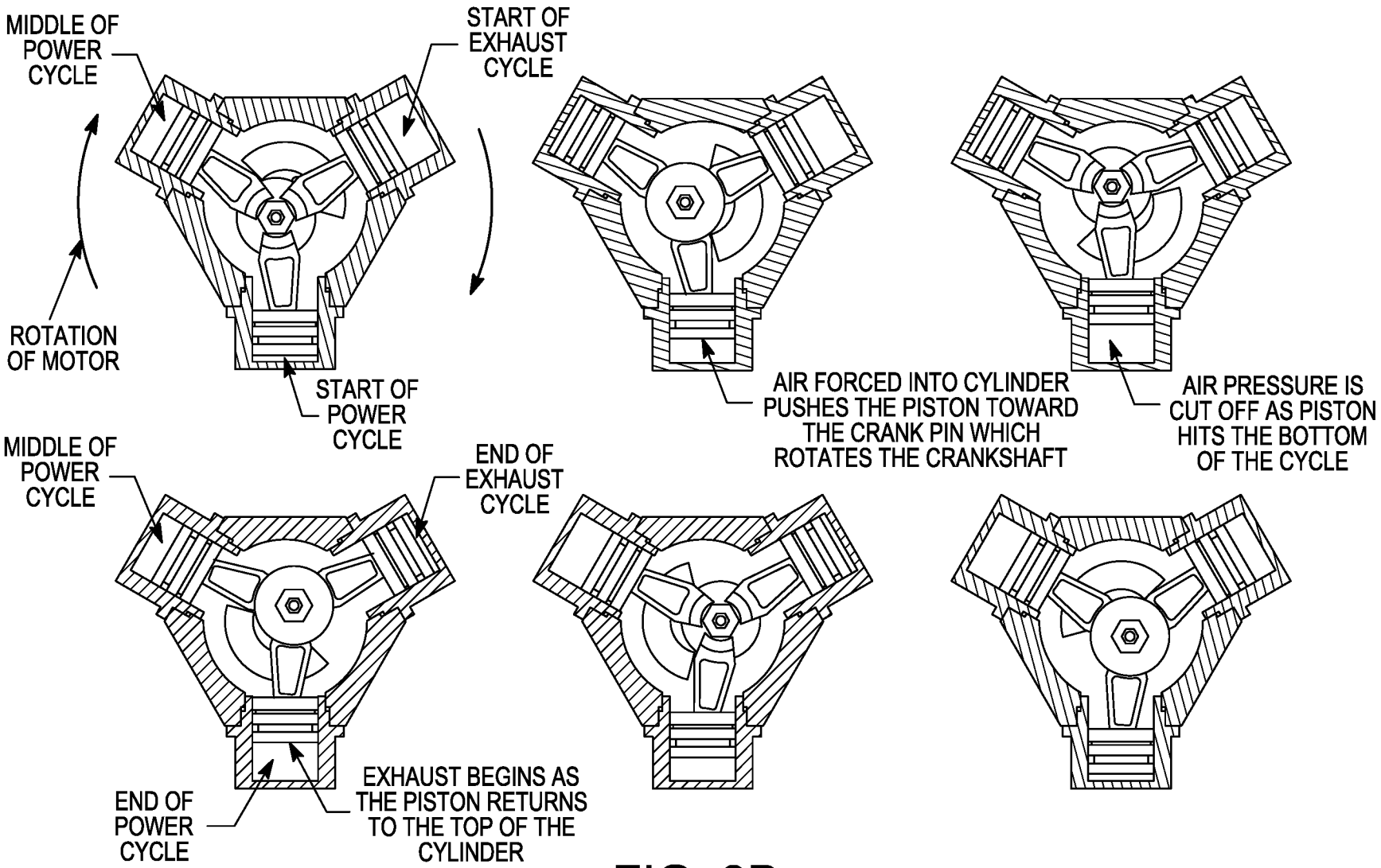
FIG. 3B is an overhead cross-sectional view of the pneumatic motor showing pistons at various stages of power stroke and exhaust stroke, according to one alternative.

Referring now to FIG. 3B, there is provided a three-cylinder pneumatic motor with a non-stacked piston arrangement and a unitary cylinder cap, at various stages of power stroke and exhaust stroke.

Figure 3C:
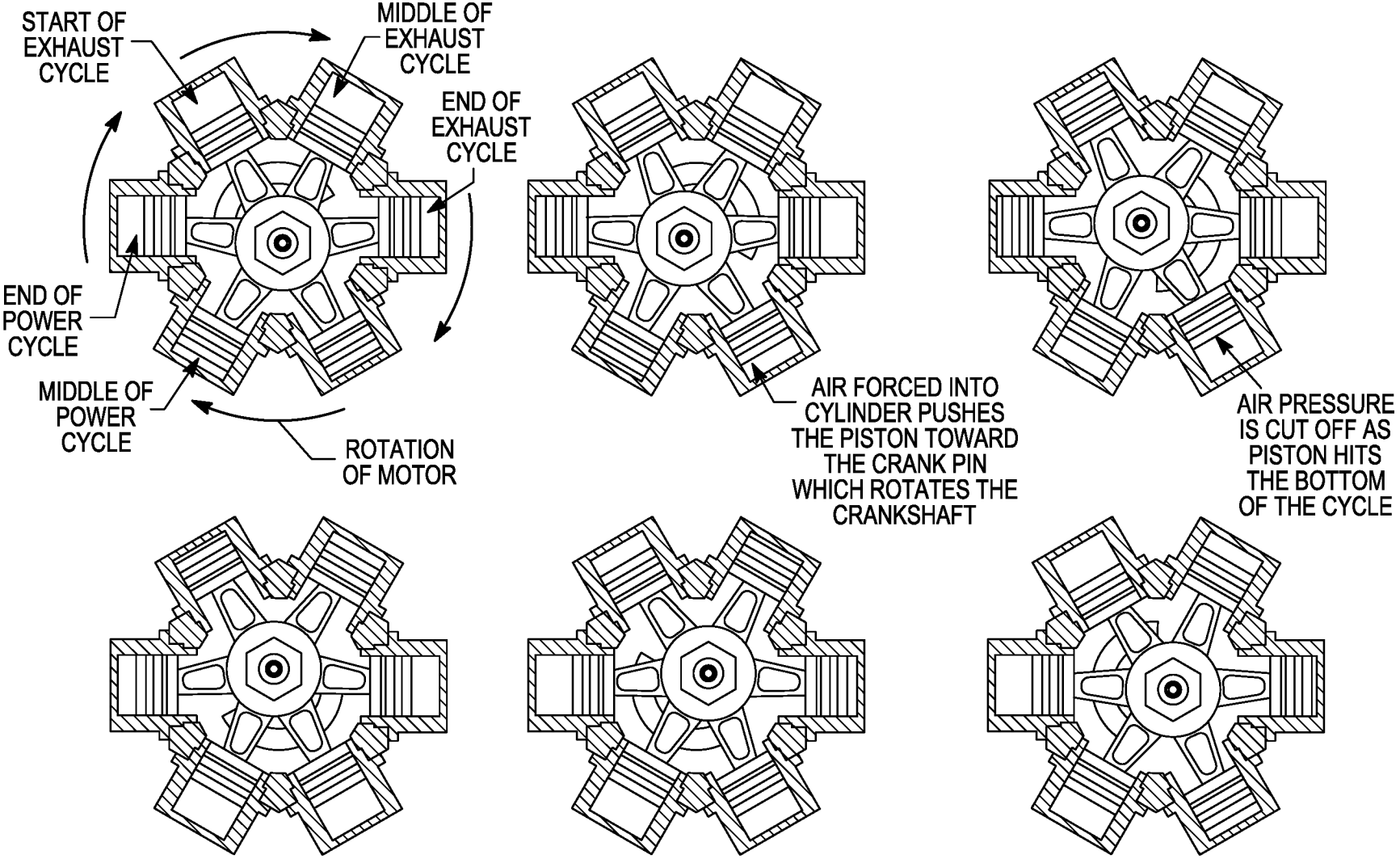
FIG. 3C is an overhead cross-sectional view of the pneumatic motor showing pistons at various stages of power stroke and exhaust stroke, according to one alternative.

Referring now to FIG. 3C, there is provided a six-cylinder pneumatic motor with a non-stacked piston arrangement and a unitary cylinder cap, at various stages of power stroke and exhaust stroke.

Figure 4:
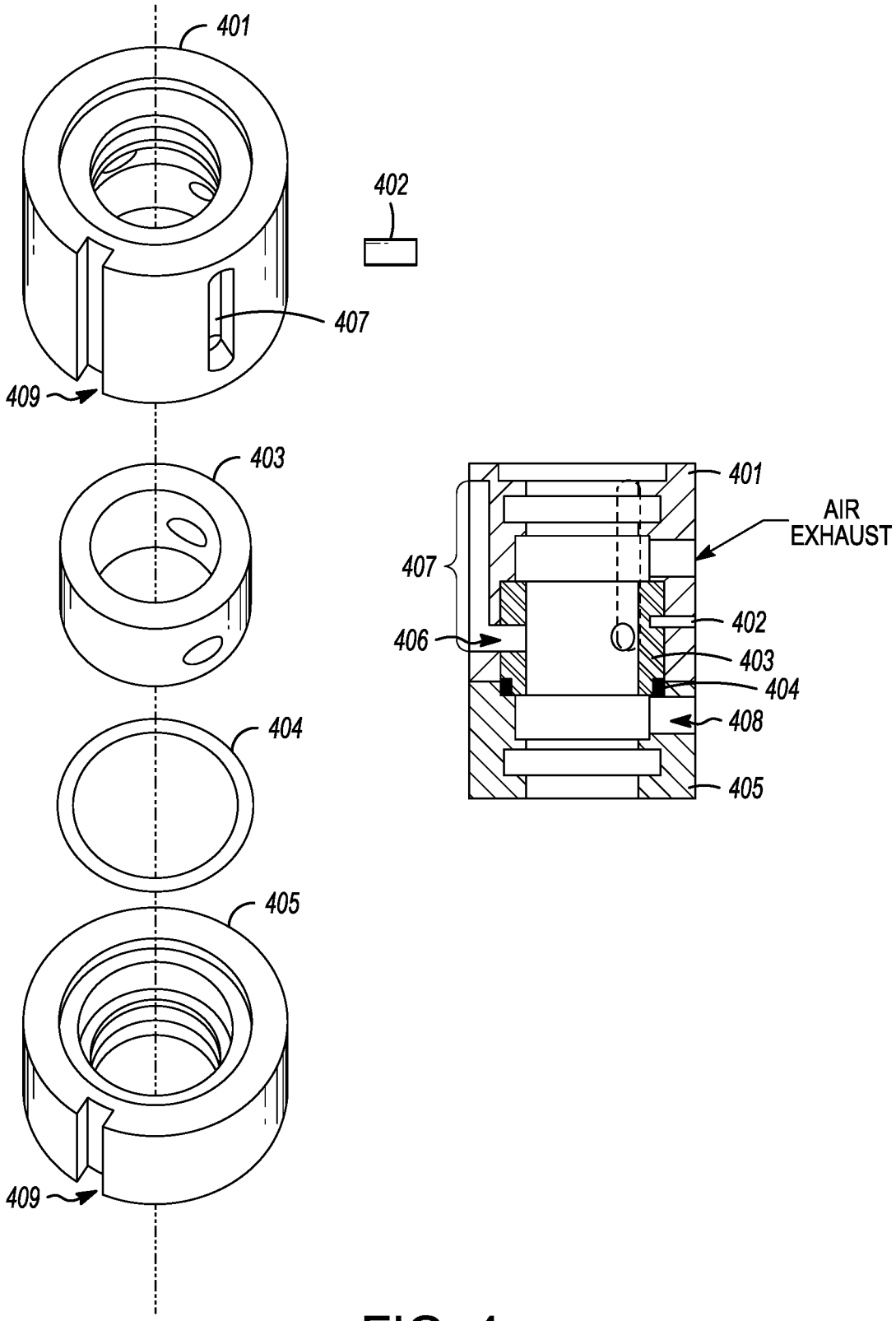
FIG. 4 is a cross-sectional view of the modular bushing, according to one alternative

Referring now to FIG. 4, there is provided a cross sectional view and exploded view of one alternative of the modular bushing depicting the upper bushing 401, lower bushing 405 and middle bushing 403. Modular bushing is a cylinder with an outer diameter to snuggly fit in the motor housing without any rotational movement and an inner diameter to snuggly fit around the axle 50 to allow axle 50 to rotate. Upper bushing 401 includes an air port 406 running radially from the outer diameter wall to the inner diameter wall of the upper bushing 401. The air port 406 serves to allow air to flow from the cylinder during an exhaust stroke. Upper bushing 401 further includes vertical channels, in this alternative three vertical channels 407 (only one depicted) for a 3 piston pneumatic motor, running lengthwise of the outer diameter wall of said bushing with an channel aperture (air port 406) located near one end of each channel, in this alternative near the lower end of the bushing. The channel aperture running radially from the outer diameter wall to the inner diameter wall serving to allow the passage of compressed air for power and exhaust to the pistons. Lower bushing 405 includes an air port 408 running radially from the outer diameter wall to the inner diameter wall of the lower bushing serving to allow air to flow from the air supply (air intake) port 30 and the cylinder during a power stroke. Middle bushing 403 serves to keep the upper bushing 401 connected to the lower bushing 405 via a friction fit of the cylindrical middle bushing 403 between the upper and lower bushings. Middle bushing further includes air ports, that when connecting the upper and lower bushings, are inline with the upper bushing channel apertures by locking into the upper bushing with a lock pin (dowel (402). Middle bushing 403 is further sealed onto lower bushing 405 by an O-ring seal 404. Modular bushing includes a keyway 409 running along the outside length of the modular bushing when assembled. The keyway 409 facilitates alignment of the modular bushing with the inside of the motor body by connecting with a key on said motor housing so the air passages on the motor body are inline with the air passages of the modular bushing, and also helps to keep the modular bushing in place in the motor body.

Figure 5:
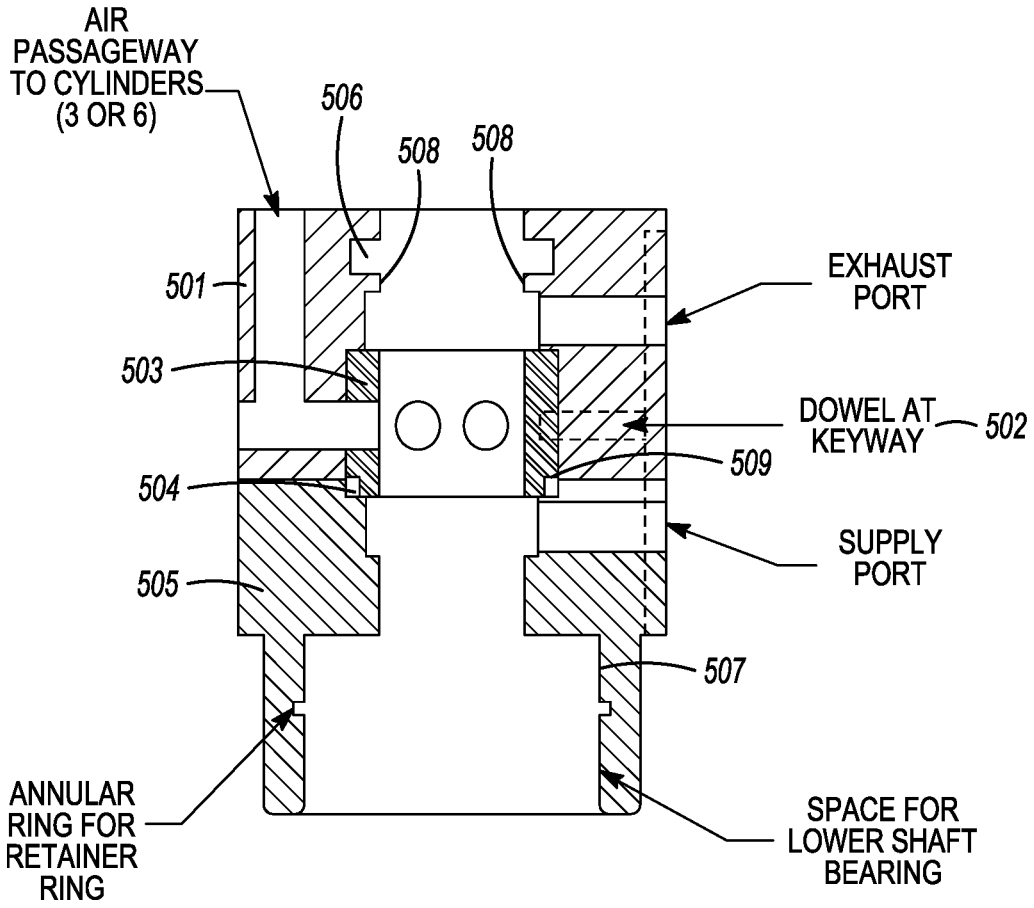
FIG. 5 is a cross-sectional view of the modular bushing, according to one alternative
Figure 5A:
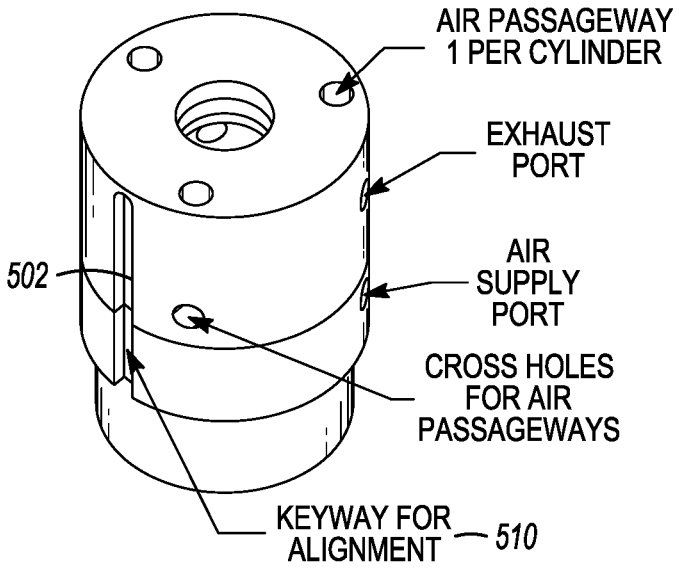
FIG. 5A is a perspective view of the modular bushing for a 3 cylinder pneumatic motor
Figure 5B:
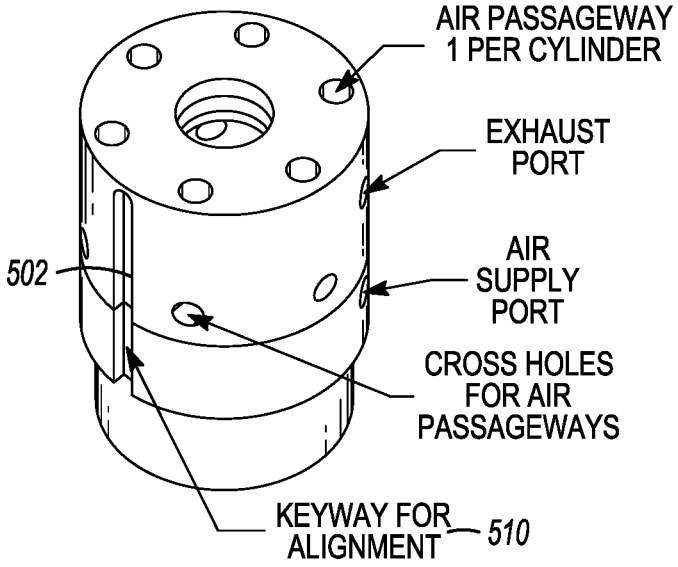
FIG. 5B is a perspective view of a modular bushing for a 6 cylinder pneumatic motor

Referring now to FIGS. 5, 5A and 5B there is depicted a modular bushing, according to another alternative. In particular, FIG. 5 depicts a modular bushing having an upper bushing 501, lower bushing 505, connected to each other with a middle bushing 503. Middle bushing 503 is sealed in place by an O-ring seal 504, sealing the middle bushing 503 to the lower bushing 505. In this alternative, middle bushing 503 includes an O-ring seal receiver 509, in the shape of a ledge along one end of the middle bushing 503. Middle bushing 503 includes radial apertures to align with air passage ways to cylinders found in the upper bushing 501. In this alternative, modular bushing has an annular ring 506 on the inside diameter of upper bushing 501. Annular ring 506 receives an O-ring (not depicted) providing a seal between the modular bushing and the shaft (or axle). In this alternative, lower bushing 505 includes an annular ring 507 on the inside of diameter of lower bushing 505. Annular ring 507 receives an O-ring providing a seal between the lower bushing 505 and the shaft (or axle). Upper bushing 501 include an annular stop ring 508 to prevent the modular bushing from slipping down the shaft (or axle). Dowel 502 is shown via keyway 510 to keep middle bushing 503 secured in placed with upper bushing 501. Keyway 510 aids in aligning the modular bushing in the pneumatic motor.

FIG. 5A provides an assembled modular bushing for a three-cylinder pneumatic motor.

FIG. 5B provides an assembled modular bushing for a six-cylinder pneumatic motor.

Figure 6A:
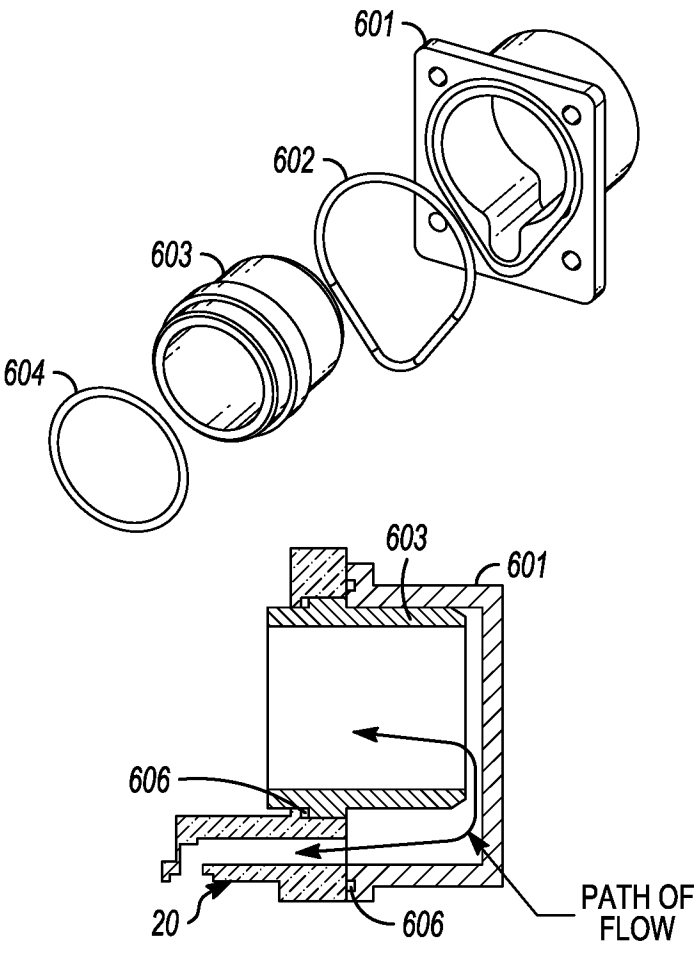
FIG. 6A (PRIOR ART)
FIG. 6A is a cross-sectional view of a prior art cylinder sleeve and cap

Referring now to FIG. 6A, there is depicted a PRIOR ART cylinder cap 601 and cylinder sleeve 603 arrangement with multiple components 602, 604.

Referring now to FIG. 6B, there is depicted a cross section of a unitary cylinder cap 605 (as seen in FIGS. 1A and 1B). FIG. 6B shows that an O-ring and a cylinder sleeve have been eliminated with the unitary cylinder cap 605 and the air passage 138 in the unitary cylinder cap 605 is angled upwards from the motor body. The unitary cylinder cap reduces the number of part required to form a seal between the cylinder cap and motor body.

Unitary cylinder cap 605 includes a motor body wall 607 to facilitate the seating of the cylinder cap 605 onto said motor body. Cylinder cap 605 includes an O-ring seal 606 to seal the air channel (138/115) against the motor body air channel 139.

Referring now to FIG. 7, there is shown a cut-away view of FIGS. 1A, 1B and 2, according to one alternative, depicting the stacked and staggered connecting rods 80 and pistons 70 secured radially offset said axle 50 by a crank pin 107.

Figure 8:
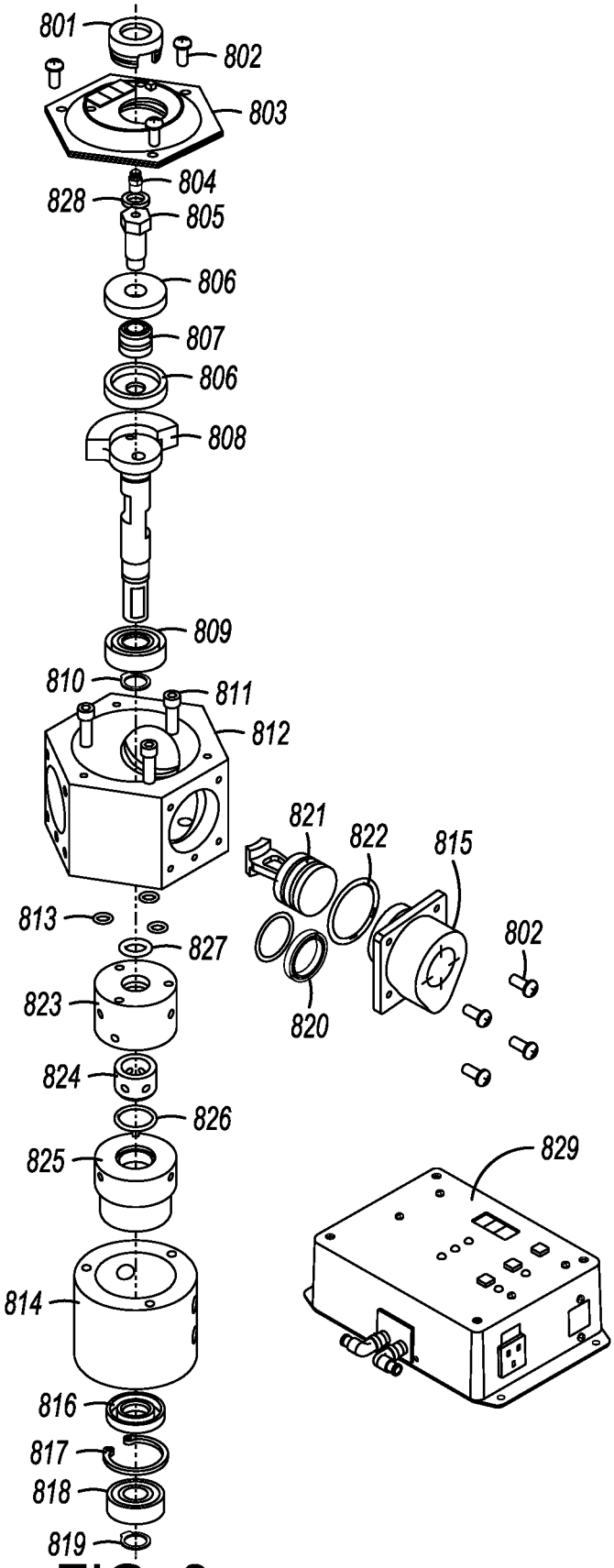
FIG. 8 is an exploded view of the pneumatic motor, as a three cylinder pneumatic motor, according to one alternative

Referring now to FIG. 8, there is depicted an exploded view of a three-cylinder pneumatic motor and associated parts, according to one alternative. In particular, the pneumatic motor includes a vent 801 attached to a tachometer 803 which communicates with a controller 829. Tachometer 803 provides information such as rotations per minute of the crankshaft 808. Controller 829, also provides rotations per minute of crankshaft 808 but also includes information such as air supply, airflow and may also allow for changing of air supply and air volume, air speed thus modifying the rotations per minute (motor speed). Tachometer 803 is secured onto the motor head 812 by three screws 802 fitting in apertures on motor 812. Vent 801 also serves as a window to allow the user to see into the pneumatic motor. The top end of crankshaft 808 includes a grease fitting which secures a magnet 828 onto the crankpin 805, which is inserted into crankshaft 808. As crankshaft 808 makes a revolution, magnet 828 simultaneously makes a revolution, tachometer 803 will take a reading and then the reading will be calculated on a per minute basis and a readout on the tachometer will provide the rotations per minute. Between crankshaft 808 and crankpin 805 are a thrust washer 806 a needle bearing 807 and a second thrust washer 806. Rod assembly 821 is prevented from moving vertically, by thrust washers 806 during the rotation of crankshaft 808 causing the rod assembly 821 to reciprocate in and out of cylinder formed by cylinder cap 815. Each unitary cylinder cap 815 is secured onto the motor head 812 by a series of four fasteners such as screws 802 and further sealed thereto by a cylinder seal 822. Rod assembly 821 further includes a piston seal 820. Crankshaft 808 sits within motor head 812 and in a three-piece modular bushing consisting of upper bushing 823 lower bushing 825 connected together via middle bushing 824. Between middle bushing 824 and lower bushing 825 is O-ring 826 to further seal middle bushing 824 two lower bushing 825. Around crankshaft 808 is bearing 809 and snap ring 810 to keep crankshaft 808 in place. Each upper air passage of upper bushing 823 is sealed with three O-rings 813 and sealed against the crankshaft 808 with a larger centrally located O-ring 827. Motor body 814 is secured to motor head 812 via three cap screws 811. Central collar 824 is sealed in place in lower bushing 825 with O-ring 826. Crankshaft 808 is further sealed near the bottom thereof with crank seal 816, held in place with snap ring 817 and further includes lower bearing 818 and snap ring 819.

Figure 9:
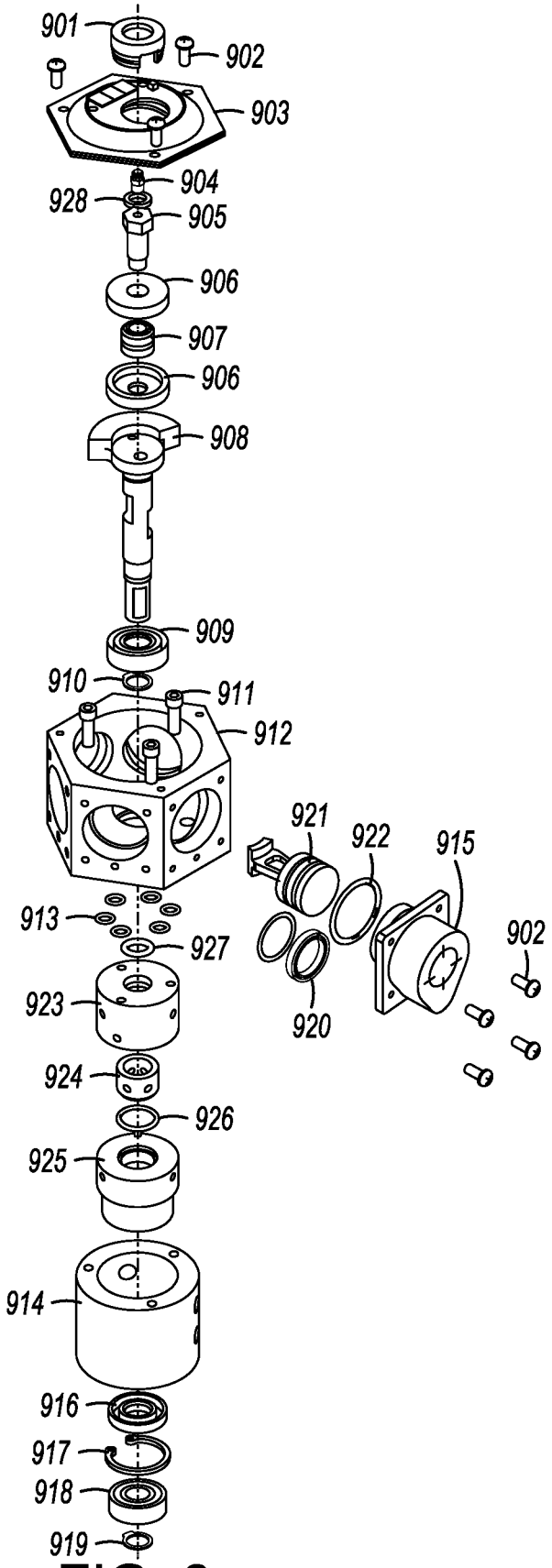
FIG. 9 is an exploded view of the pneumatic motor, as a six cylinder pneumatic motor, according to one alternative

Referring now to FIG. 9, there is depicted an exploded view of a six-cylinder pneumatic motor and associated parts, according to one alternative with all parts listed thereon being the same as those of FIG. 8 except there are six-cylinders rather than three-cylinders.

The following is an example comparing a pneumatic motor using a prior art unitary bushing versus a modular bushing.

Two pneumatic motors, one with a modular bushing and unitary cylinder caps described herein and one with a one piece prior art bushing were run under the same conditions and air consumption was measured. Pressure was regulated at various levels, rotations per minute (RPM) was kept constant at 100 and maximum torque (in-lb) and air consumption at cubic feet per minute (CFM) was measured.

3 Cylinder Motor with a Modular Bushing and Unitary Cylinder Caps

SUPPLY PRESSURE: 120 P.S.I. (pounds per square inch). These values represent an average of 10-3 cylinder pneumatic motors assembled with a modular 3 piece bushing.

| P.S.I. | CFM | RPM | MAX TORQUE |
|---|---|---|---|
| 20 | 0.61 | 100 | 1.4 |
| 25 | 0.81 | 100 | 2.13 |
| 30 | 0.95 | 100 | 2.79 |
| 35 | 1.09 | 100 | 3.47 |
| 40 | 1.22 | 100 | 4.13 |
| 45 | 1.36 | 100 | 4.78 |
| 50 | 1.51 | 100 | 5.61 |
| 55 | 1.66 | 100 | 6.36 |
| 60 | 1.81 | 100 | 7.02 |
| 65 | 1.94 | 100 | 7.74 |
| 70 | 2.11 | 100 | 8.5 |
| 75 | 2.27 | 100 | 9.12 |
| 80 | 2.41 | 100 | 9.95 |
| 85 | 2.54 | 100 | 10.57 |
| 90 | 2.72 | 100 | 11.33 |
| 90 | 1.21 | 0 - stall | 12.03 |

Prio Art 3 Cylinder Motor with a Unitary Bushing and Multicomponent Cylinder Caps

SUPPLY PRESSURE: 120 P.S.I.

These values represent an average of 3-3 cylinder pneumatic motors assembled with a 1 pc bushing.

| P.S.I. | CFM | RPM | MAX TORQUE |
|---|---|---|---|
| 20 | 1.06 | 100 | 0.79 |
| 25 | 1.27 | 100 | 1.51 |
| 30 | 1.48 | 100 | 2.17 |
| 35 | 1.73 | 100 | 2.83 |
| 40 | 1.94 | 100 | 3.48 |
| 45 | 2.21 | 100 | 4.36 |
| 50 | 2.47 | 100 | 5.04 |
| 55 | 2.67 | 100 | 5.61 |
| 60 | 2.91 | 100 | 6.34 |
| 65 | 3.18 | 100 | 6.97 |
| 70 | 3.48 | 100 | 7.72 |
| 75 | 3.73 | 100 | 8.57 |
| 80 | 3.95 | 100 | 9.2 |
| 85 | 4.21 | 100 | 9.98 |
| 90 | 4.55 | 100 | 11.12 |
| 90 | 2.91 | 0 - stall | 13.05 |

As can be seen, unexpectedly the air consumption of the same pneumatic motor with a modular bushing used substantially less air in CFM while maintaining the same RPM and very close maximum torque when compared to a unitary bushing.

The following is a calculation of return on investment with a 6 cylinder pneumatic motor described herein having a modular bushing.

1 horsepower (HP) is equal to 746 watts (W) or 0.746 KW (¾ KW)

On average most compressors will produce 4 CFM @ 90 PSI per 1 HP Therefore: @ 90 PSI it takes 0.746 KW (¾KW) to produce 4 CFM. 0.746 KW divided by 4 CFM=0.1865 KW for 1 CFM.

Therefore, it takes 0.1865 KW to produce 1 CFM.

Calculation of Cost Savings

Step 1. Calculate the CFM difference with pneumatic motor described herein and a prior art motor using a simple CFM gauge.

Example: Prior art 3 cylinder pneumatic motor: 4.55 CFM pneumatic motor 3 cylinder pneumatic motor (with 3 pc. Bushing): 2.72 CFM. Difference in CFM usage=1.83 CFM.

Step 2. Calculate local electrical supply costs.

For this example we will use $0.10 per kwh (it cost $0.10 to create 1 KW for 1 hour).

Step 3. Take what is known: 0.1865 kw/CFM and multiply it by hrs/day (24) and days/year (365) 0.1865×24×365=1,633.74 KW Conclusion: It takes 1,633.74 KW to create one CFM for 24 hrs a day for 1 year.

Step 4. Multiply your kw/year value (1,633.74) by your local electricity supply costs ($0.10/kwh)

$$1{,}633.74\times\$0.10=\$163.37$$

Conclusion: It takes $163.37 to create 1 CFM 24 hrs a day for 1 year.

Step 5. Multiply the cost to create 1 CFM/year ($163.37) by the total difference in CFM (1.83) $163.37×5.48=$298.96

Conclusion: The total savings (in compressed air alone) over 1 year when using the pneumatic motor described herein compared to a prior art motor with a unitary bushing is $298.96 per pneumatic motor.

The following provides the difference in operating temperature comparing a prior art pneumatic motor with the pneumatic motor described herein.

Temperature readings were taken near the cylinder cap from a three cylinder pneumatic motor after one hour of run time at ambient room temperature of 65 degrees F.

Pneumatic motors were each ran at 200 RPM

| UNITARY CYLINDER CAP | PRIOR ART 2 PC. CAP AND SLEEVE |
|---|---|
| 66 deg. | 82 deg. |
| 68 deg. | 81 deg. |
| 66 deg. | 83 deg. |
| 69 deg. | 82 deg. |
| 68 deg. | 84 deg. |

There is a significant decrease in temperature (16-20% lower) during run time when a unitary cylinder cap is used versus the prior art multi-piece cylinder cap Pneumatic motors were each ran at 800 RPM

| UNITARY CYLINDER CAP | PRIOR ART 2 PC. CAP AND SLEEVE |
|---|---|
| 74 deg. | 94 deg. |
| 70 deg. | 98 deg. |
| 76 deg. | 101 deg. |
| 77 deg. | 97 deg. |

-continued

| UNITARY CYLINDER CAP | PRIOR ART 2 PC. CAP AND SLEEVE |
|---|---|
| 75 deg. | 98 deg. |

There is a significant decrease in temperature (21-29% lower) during run time when a unitary cylinder cap is used versus the prior art multi-piece cylinder cap.

In terms of construction material:

the motor housing may be made of aluminum, zinc, steel, cast iron, stainless steel, nylon, and combinations thereof;

the vent may be made of nylon, acetal, glass filled nylon, low density polyethylene, and combinations thereof;

the head cover may be made of aluminum, zinc, steel, cast iron, stainless steel, nylon, and combinations thereof;

the crank pin may be made of steel, stainless steel, 4140 alloy steel and combinations thereof;

the spacer may be made of steel, stainless steel, nylon, fiber and combinations thereof;

the bearings may be made of steel, stainless steel and combinations thereof;

the piston head may be made of glass filled nylon, acetal and combinations thereof;

the connecting rod may be made of steel, brass, aluminum, Delrin, nylon, glass filled nylon, aluminum filled nylon and combinations thereof;

the wrist pin may be made of steel, stainless, brass, bronze and combinations thereof;

the piston seal may be made of urethane, Buna-N—O-rings, fluoroelastomer, Teflon, UHMW polyethylene and combinations thereof;

the cylinder cap O-ring may be made of Buna, Fluoroelastomer, ethylene propylene diene terpolymer (EPDM rubber), Teflon™, fluorinated ethylene propylene (FEP) sold by DuPont, TFE/P rubber (Aflas™ by DuPont), perflouro elastomer (Kalrez™ by DuPont USA) and combinations thereof;

the crankshaft (axle) may be made of steel, stainless Steel, 4140 alloy steel and combinations thereof;

the upper and lower bearings may be made of steel or stainless steel and combinations thereof;

the upper and lower bushings may be made of steel, stainless steel, Phenolic resin laminate, glass filled nylon and combinations thereof;

the middle bushing may be made of Torlon™ by Solvay Specialty Polymers, poly-vinylidene fluoride, glass filled Teflon™, Teflon™, low density polyethylene (LDPE), high density polyethylene (HDPE), ultra high molecular weight (UHMW) Polyethylene, polypropylene, CE grade phenolic laminates, LE grade phenolic laminates, nylon and combinations thereof;

As many changes can be made to the disclosure herein without departing from the scope thereof; it is intended that all matter contained herein be considered illustrative and not in a limiting sense.

The invention claimed is:

1. A pneumatic motor for rotating an axle comprising:

a. A housing comprising an air intake port;

b. an air exhaust port;

c. at least three cylinders; each cylinder being positioned radially from the axle; each cylinder being in a distinct cylinder radial plane from each other;

d. at least two air channels in communication with each cylinder;

e. at least three pistons, each piston attached to the axle by a connecting rod, each piston and respective connecting rod being radially aligned, in respect of the axle and in a distinct piston radial plane from each other, each piston to be received in one of said at least three cylinders; each connecting rod being attached centrally offset in relation to a central axis of said axle; and f. a modular bushing fit onto said axle to regulate communication of said air intake port and said air exhaust port with said at least two air channels in communication with each cylinder;

wherein said modular bushing comprises a lower component, an intermediate component and an upper component, wherein each of said upper component and lower component further comprise a connecting collar receiving section to receive an end of a connecting collar axially connecting the upper component with the lower component forming a cylinder valve bushing for said pneumatic motor; wherein the lower component includes an upper area of a first diameter and a lower area of a second diameter allowing the connecting collar to be friction fitted within the upper and lower component, wherein the upper component and lower component are each cylinders, each having a same outer diameter and a same inner diameter relative to each other;

wherein during a power stroke of one piston, said axle allows said air intake port to be in communication with the air channel in communication with one cylinder allowing air from the air intake port to enter into the cylinder; and during an exhaust stroke of one piston, said axle allows said air exhaust port to be in communication with the air channel in communication with said one cylinder allowing air to exit the cylinder through the air exhaust port;

wherein when one connecting rod and piston are in power stroke, the other connecting rod and piston are in exhaust stroke and a third connecting rod and piston are in between an exhaust stroke and a power stroke.

2. The pneumatic motor of claim 1 further comprising at least three unitary piston cylinder caps, each cylinder cap forming a cylinder, on said pneumatic motor, each cylinder receiving a respective one of said at least three pistons.

3. The pneumatic motor of claim 1 further comprising at least three unitary piston cylinder caps, each cylinder cap forming a cylinder, on said pneumatic motor, each cylinder receiving a respective one of said at least three pistons, wherein each of said at least three unitary piston cylinder caps further comprise an cylinder cap air channel for communication with said air channel in communication with said cylinder of said pneumatic motor housing for exchange of air into and out of a space formed by each of said at least three pistons and each of said at least three unitary piston cylinder caps.

4. The pneumatic motor of claim 1 wherein one end of each of said connecting rods are stacked one atop another on said axle, in an axially offset configuration, resulting in each of said connecting rods and each of said pistons connected to said connecting rod being in a distinct radial plane, each distinct radial plane being parallel to each other.

5. The pneumatic motor of claim 1 wherein said upper component and lower component matingly engaged with each other by said intermediary component.

6. The pneumatic motor of claim 1 wherein said intermediary component is said connecting collar for connecting said upper component with said lower component.

7. The pneumatic motor of claim 1 wherein said upper component is a hollow cylinder having a top surface, a bottom surface, an outer collar surface and an inner collar surface, and wherein said upper component further comprises a plurality of air inlet and outlet channels, wherein said lower component further comprises at least one air intake channel running axially to said hollow cylinder, wherein said air inlet channels of said upper component are in fluid communication with said at least one air intake channel of said lower component when said air intake face of said axle is in line with said at least one air intake channel of said lower component, during rotation of said axle, wherein said air outlet channels of said upper component are in fluid communication with said air exhaust port when said air exhaust face of said axle is in line with said air outlet channels of said upper component, during rotation of said axle.

* * * * *